United States Patent [19]

McNeil

[11] Patent Number: 4,919,351

[45] Date of Patent: Apr. 24, 1990

[54] WEB REWINDER HAVING IMPROVED CHOP-OFF MECHANISM

[75] Inventor: Kevin B. McNeil, Maineville, Ohio

[73] Assignee: The Procter & Gamble Company, Cincinnati, Ohio

[21] Appl. No.: 320,200

[22] Filed: Mar. 7, 1989

[51] Int. Cl.[5] ..... B26F 3/02; B65H 35/10

[52] U.S. Cl. ..... 242/56 R; 83/328; 225/105; 242/56.8

[58] Field of Search ..... 242/56 R, 56.8; 83/323, 83/327, 328; 225/105

[56] References Cited

U.S. PATENT DOCUMENTS

| | | | |
|---|---|---|---|
| 3,293,970 | 12/1966 | Brockmüller | 83/328 |
| 3,567,552 | 3/1971 | Heuff et al. | 242/56 R X |
| 4,487,377 | 12/1984 | Perini | 242/56.8 |
| 4,687,153 | 8/1987 | McNeil | 242/56.8 |

FOREIGN PATENT DOCUMENTS

| | | | |
|---|---|---|---|
| 2413992 | 10/1975 | Fed. Rep. of Germany | 83/328 |
| 2715280 | 10/1978 | Fed. Rep. of Germany | 83/328 |

*Primary Examiner*—Joseph J. Hail, III

*Attorney, Agent, or Firm*—Thomas J. Slone; John M. Pollaro; Fredrick H. Bruan

[57] ABSTRACT

An improvement in web converting rewinders of the type which include a perforator cylinder, and a bedroll/chop-off roll combination comprising a set of chop-off blades, some of which chop-off blades are disposed on the bed roll, and some of which are disposed on the chop-off roll; and in which a running web is forwarded from an unwinding parent roll, and is converted into consumer product rolls such as, for example, tear-separable multi-sheet rolls of toilet tissue or paper towels. The improvement comprises parallel-motion chop-off blades which can be more closely spaced than in prior art chop-off blades, and thus induce greater stretching and more positive breaking of the web; and, preferably, the chop-off blades are disposed to act on a longer machine-direction-length of the running web than contemporary rewinders to enable more positively inducing roll endings by breaking along transverse lines of weakening rather than by inducing ragged transverse tears of the web. Such a disposition of the chop-off blades provides a wider window in which the lines of weakening in the running web may be indexed during each roll-edging chop-off event. Such an indexed relationship between the chop-off mechanism and the running web is easier to continuously maintain with such a wider window, all other factors being constant. This invention is particularly useful for webs such as creped paper which must be stretched substantially in the machine direction before they will break along transverse lines of weakening such as lines of spaced cuts or lines of perforations.

7 Claims, 6 Drawing Sheets

WEB REWINDER HAVING IMPROVED CHOP-OFF MECHANISM

DESCRIPTION

1. Technical Field

The invention pertains to apparatus —commonly called rewinders —for unwinding parent rolls of web material such as, for example, paper, and rewinding the web onto cores to produce consumer rolls of web products: for example, rolls of paper towels, or rolls of toilet paper. More specifically it pertains to providing such a rewinder which comprises improved chop-off means: improved means for breaking a running web along transverse lines of weakening in the web to effect roll ending events.

2. Background

Rewinders are, for example, apparatus for unwinding parent rolls of web material such as paper or film, and rewinding the web into consumer product rolls such as rolls which comprise multiple tear-apart sheets: e.g., toilet paper or paper towels. Rewinders may include a perforating cylinder for making transverse lines of perforations in the web at sheet length intervals to provide tear apart convenience, and a bedroll/chop-off roll combination comprising a set of chop-off blades for separating roll lengths of paper by breaking the paper along one of the lines of perforations: i.e., lines of weakening.

A rewinder of that type wherein one of the chop-off blades is disposed on the chop-off roll per se, and two on the bedroll, is disclosed in U.S. Pat. No. 4,687,153 which issued Aug. 18, 1987 to Kevin B. McNeil (the inventor herein), and which patent is incorporated herein by reference. In that rewinder, the cut-off blades extend radially. Thus, they have a rolling action with respect to each other as they mesh to execute a chop-off, roll ending event. As the blade of the chop-off roll enters and exits the space between the radially extending blades of the bedroll, it is angularly misaligned with the bedroll's blades. Only at the center of the meshing are the blades in parallel relation. As the meshing occurs, the length of the running web of paper which extends between the tips of the bedroll's chop-off blades is stretched into a deepening V-shape. There must be sufficient meshing to ensure sufficient stretching to induce either breaking or tearing of the web, or the rewinder will try to wind larger rolls than intended, and thus malfunction. When the running web is indexed with the chop-off mechanism so that that length of running web includes a line of perforations, the web is broken along the line of perforations. When not indexed and that length of web does not include a line of perforations, such stretching of the web induces ragged transverse tearing of the web: an esthetically displeasing roll end.

As compared to the non-parallel, rolling-motion chop-off blade mechanism of U.S. Pat. No. 4,687,153 described above, the present invention provides parallel motion chop-off blades and, preferably, a wider chop-off window. As more fully described hereinafter, the improved mechanism provides greater stretching for a given mesh and a given width chop-off window than the non-parallel-action mechanism; and may effectively utilize a wider chop-off window than the non-parallel-action mechanism. This assures more positive breaking of the running web to execute roll ending events at esthetically pleasing lines of perforation; and, through the incorporation of a wider window, the apparatus may be made less sensitive to web property changes that would otherwise disrupt the indexed relationship which must be maintained between the lines of perforation of the running web and the chop-off mechanism to effect such esthetically pleasing roll ends. This invention is particularly useful with respect to webs which are very stretchy: creped paper webs, and thermoplastic films albeit it is not intended to thereby limit the scope of the present invention.

DISCLOSURE OF THE INVENTION

The invention provides improved rewinders (for paper and other webs) of the type which include means such as a perforator cylinder and compatible anvil for perforating a running paper web at sheet length intervals to provide tear-apart convenience; chop-off means for breaking or otherwise parting the running web at product roll length intervals which means comprises a bedroll, a chop-off roll, means for rotating the rolls in timed relation, a set of chop-off blades, some of which radially extend from the bedroll and some of which radially extend from the chop-off roll, and means for enabling the chop-off blades to mesh at timed intervals to effect roll ending events; and means such as a multi-mandrel turret assembly for winding each product roll length of the web onto, for example, a disposable core to make such rolled products as toilet paper and disposable paper towels.

In accordance with one aspect of the present invention, such an improved rewinder for converting parent rolls of web into multi-separable-sheet product rolls is provided which comprises improved chop-off means which further comprise means for continuously maintaining the chop-off blades in parallel relationship. Such means for continuously maintaining the chop-off blades in parallel relationship may comprise means for orbiting the chop-off roll in a circular orbit adjacent the bedroll and in timed relationship therewith, and means for rotating the chop-off roll on its axis at the same spatial angular velocity as the bedroll, and means for indexing the orbiting means with the rotation of the bedroll so that the blade or blades of the chop-off roll are parallel to, velocity synchronized with, and mesh with the blades of the bedroll during roll ending events.

In a preferred aspect of the invention, the set of chop-off blades comprises two side-by-side blades on the chop-off roll, and three side-by-side blades on the bedroll; and the angular orbital velocity of the chop-off roll is twice the angular velocity of the bedroll but opposite in direction.

BRIEF DESCRIPTION OF DRAWINGS

While the specification concludes with claims which particularly point out and distinctly claim the subject matter regarded as forming the present invention, it is believed the invention will be better understood from the following description taken in conjunction with the accompanying drawings in which identical features in the several views are identically designated and in which:

DETAILED DESCRIPTION OF THE INVENTION

Figure 1:
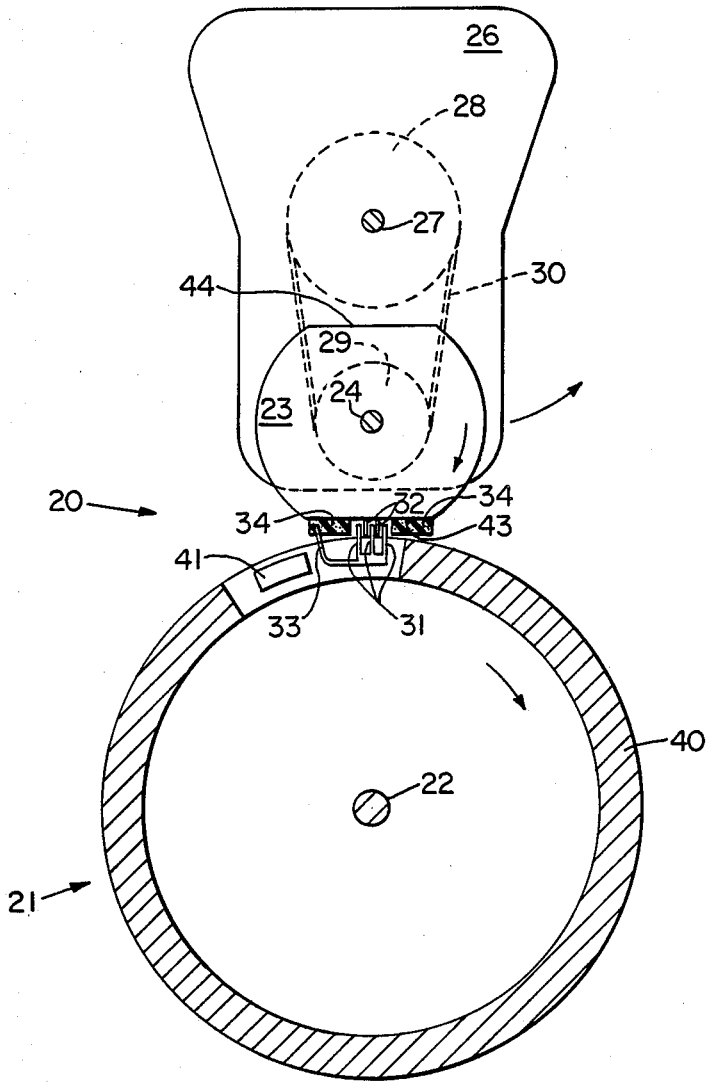
FIG. 1 is a fragmentary, partially cut away, side elevational view of an improved chop-off mechanism which embodies the present invention.

An exemplary, improved chop-off mechanism 20 which embodies the present invention is shown in FIG. 1 to comprise a bedroll 21, a bedroll shaft 22, a chop-off roll 23, a chop-off-roll shaft 24, a chop-off-roll carrier 26, a shaft 27 on which carrier 26 is secured, timing pulleys 28 and 29, and timing belt 30. Additionally, three parallel, radially extending chop-off blades 31 which are elements of bedroll 21 are shown in their extended positions; and are shown in meshed, parallel relation with two chop-off blades 32 which extend radially from a flat-faced portion of chop-off roll 23. Blades 31 and 32 comprise a 5-blade set.

Briefly, a chop-off mechanism is a portion of a type of rewinder apparatus which is used to convert parent rolls of paper and other web materials to product size rolls: for example, rolls of toilet tissue and rolls of disposable paper towels. It is conventionally disposed between a perforator which perforates the web along transverse lines that are spaced at sheet-length intervals in the machine direction, and a roll winder per se which winds the web into rolls having, preferably, a predetermined sheet count. The chop-off mechanism, being between the perforator and the winder, is provided to periodically sever or break the web so that the roll being wound can be completed, and to provide a starter-end for the next subsequent roll. Such severing or breaking events are hereinafter referred to as roll ending events; and, preferably, breaking is induced along a transverse line of weakening such as, for example, line of perforations. Such breaking may also be referred to as rupturing, while severing which does not occur along a line of perforations generally is characterized as a ragged tear.

The exemplary chop-off mechanism 20, FIG. 1, is an improved chop-off mechanism which embodies means for providing parallel motion chop-off blades; and which may effectively be operated with a wider window than prior art apparatuses. These ensure more reliable, consistent roll ending events; events during which the running web of paper is ruptured or broken along transverse lines of perforations. As the rotating elements of the chop-off mechanism 20, FIG. 1, are rotated in the directions indicated by the adjacent arrows, and they approach the positions shown in FIG. 1, the chop-off blades 31 are extended radially to the position shown by means not shown (but which are fully described in U.S. Pat. No. 4,687,153 which has been incorporated herein by reference). At that time, the web is raised from the adjacent surface of the bedroll 21, and spans the distal tips of the chop-off blades 31. The web is also impaled at this time on a transverse row of pins 33, only one of which is visible in FIG. 1. Also, at this time, the web is indexed with the chop-off mechanism so that a line of perforations in the web is disposed in the length of web that spans the tips of blades 31. Upon further rotation towards the positions shown in FIG. 1, the resilient pads 34 press the web against the tips of chop-off blades 31, and the chop-off blades 32 enter the spaces between the chop-off blades 31. As they do this, and as more fully described hereinafter, they are in parallel relation. Thus, the meshing of blades 31 and 32 is a non-contacting, sliding movement rather than a rolling type, gear-like meshing of prior art apparatuses. As the meshing progresses, the length of paper which spans the tips of blades 31, is stretched into a deepening W-shape until the above mentioned line of perforations breaks. The pins 33 and the pads 34 function to help maintain control over the free ends of the paper until the just completed roll is finished, and the next subsequent roll is started as also described in U.S. Pat. No. 4,687,153.

Bedroll 21, FIG. 1, further comprises a shell 40, and radially moveable booties 41. Except for roll end/begin events, the radially moveable booties and the assemblage of blades 31 are disposed in their retracted positions below the surface of shell 40. During roll end/begin events they are extended through a cross machine direction oriented array of slots in shell 40 for the purposes described herein. Additionally, bedroll 21 comprises means not shown for being mounted on shaft 22, and for being motor rotated in timed relation with the other elements of the mechanism and the web as described herein.

Chop-off roll 23, FIG. 1, is cylindrical but for having oppositely disposed flat faces 43 and 44. The assemblage of chop-off blades 32 is mounted on the middle portion of face 43, and they are flanked by resilient pads 34. In a preferred embodiment, the tips of the blades 32 are in the radius-circle of the circular portions of the roll. The opposite side of the roll —face 44 —is flattened as a means of balancing the roll.

Chop-off-roll carrier 26, FIG. 1, has a narrow end and a tapered end. It is provided with means for being rotatably mounted on shaft 27, and rotatably driven by a motor and drive train, not shown, in timed relation with bedroll 21. It is also provided with means for having chop-off roll 23, rotatably mounted thereon on shaft 24. Additionally, means are provided for mounting timing pulley 28 on shaft 27 so that pulley 28 does not rotate: repeat, pulley 28 does not rotate; it is spatially fixed/stationary. The wider tapered end of the carrier is provided to dynamically balance the effect of having the chop-off roll mounted on its narrow end.

Timing pulley 29 is affixed on shaft 24 so that, as pulley 29 is rotated, it rotates shaft 24, and chop-off roll 23 which is also affixed to shaft 24.

Timing belt 30 is looped about the non-rotating, stationary timing pulley 28, and the rotatably mounted timing pulley 29 so that pulley 29 rotates shaft 24 and chop-off roll 23 in a fixed timed relation with the rotation of carrier 26 as described more fully below.

The chop-off mechanism 20, FIG. 1, is assembled as described above, and as shown in FIG. 1. In operation, shaft 27 and 22 are rotated in timed relation by means not shown: the bedroll 21 rotates clockwise; and the chop-off-roll carrier 26 rotates counterclockwise. As chop-off-roll carrier 26 rotates, it carries chop-off roll 23 about a circular orbit. Inasmuch as timing pulley 28 is stationary (non-rotating), and chop-off roll 23 is orbiting, and because timing pulleys 28 and 29 are connected by timing belt 30, chop-off roll 23 is caused to rotate about its own axis: the axis of shaft 24.

In a preferred embodiment of the invention, the bedroll 21 has a diameter of 14.324 inches (about 36.4 cm); the chop-off roll has a diameter of six inches (about 15.2 cm); the center to center distance between shafts 22 and 27 is 15.521 inches (about 39.4 cm); the center to center distance between shafts 24 ad 27 is 5.275 inches (about 13.4 cm); blades 31 have a thickness of sixty thousandths of an inch (about 0.15 cm), are spaced about one quarter inch apart (about 0.64 cm), and extend 0.384 inches (about 0.98 cm) above the surface of bedroll 21 when in their extended position; blades 32 also have a thickness of about sixty thousandths of an inch (about 0.15 cm), are spaced about one-fourth inch apart (about 0.64 cm), are one-half inch (about 1.27 cm) high, and their distal ends are in the radius circle of chop-off roll 23. This geometry provides a maximum mesh (i.e., overlap of blades 31 with blades 32) of three-tenths of an inch (about 0.76 cm). Additionally, chop-off-roll carrier 26 rotates counterclockwise at twice the angular rate of the bedroll's clockwise rotation; and chop-off roll 23 rotates clockwise on its axis at three times the angular rate of bedroll 21. Thus, spatially, chop-off roll 23 has the same angular rate of rotation as bedroll 21, and they rotate in the same direction. Therefore, because the mechanism is assembled so that blades 31 are parallel to blades 32 when assembled, they will continuously remain in parallel relation during the operation of the rewinder. Additionally, this geometry provides substantially equal velocities to blades 31 and 32 as they move into and out of meshed relations: i.e., execute a roll end, web breaking event.

Figure 3:
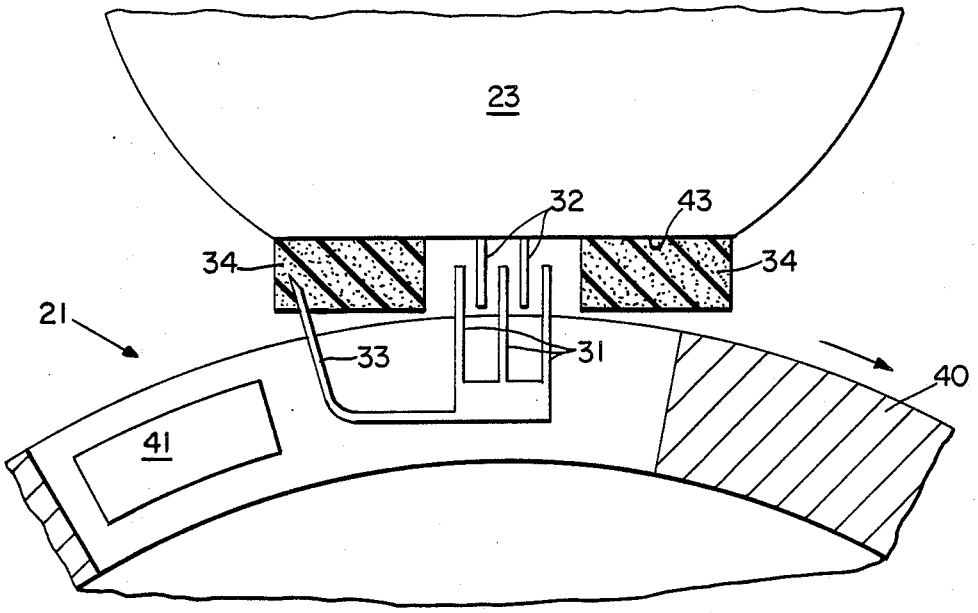
FIG. 3 is an enlarged scale view of a portion of the mechanism shown in FIG. 1.
Figure 5:
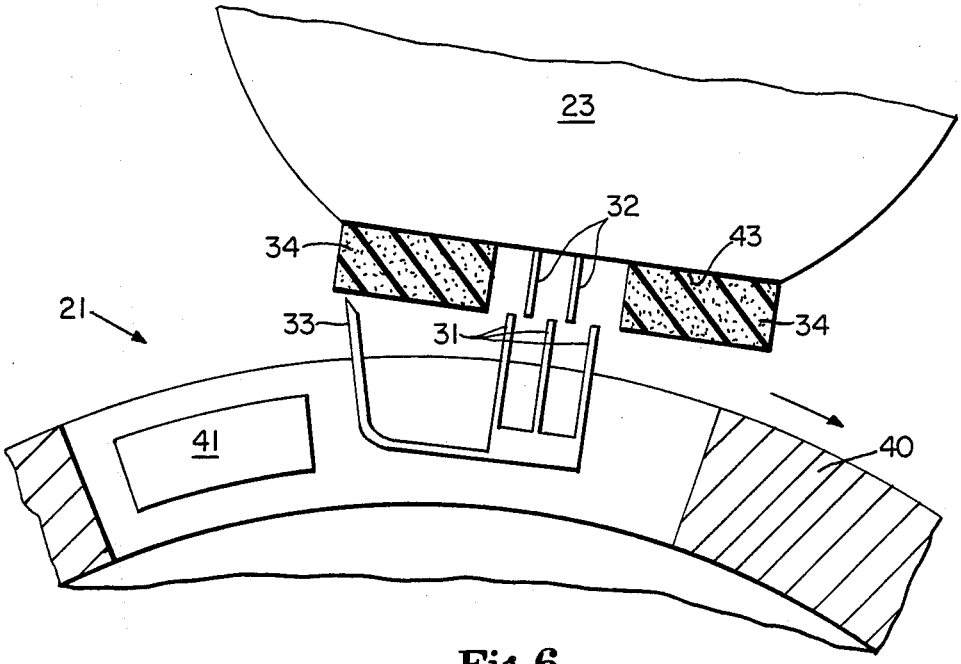
FIG. 5 is a view of the mechanism of FIG. 3 after its rotational elements have both been rotated clockwise to position their chop-off blades at their just-leaving-mesh positions.
Figure 7:
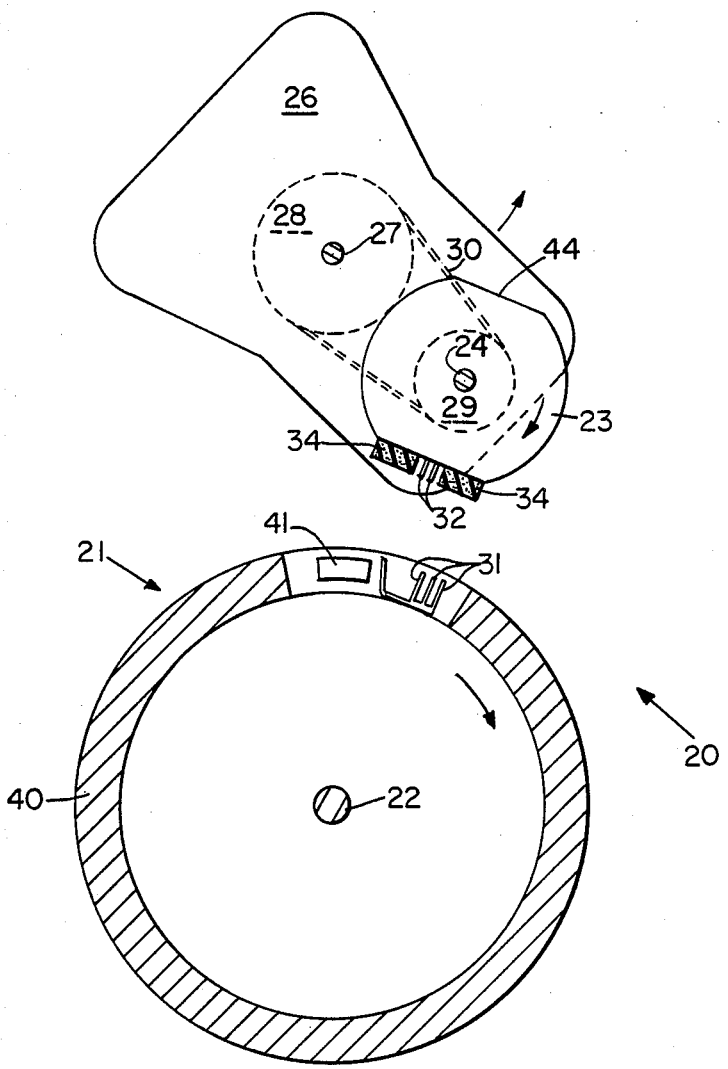
FIG. 7 is a view of the chop-off mechanism of FIGS. 1, 3, and 5 after its rotational elements have been rotated far enough beyond their FIG. 5 positions that the radially extensible/retractable chop-off blades of the bedroll have been retracted by means not shown.

The above described operation of a preferred embodiment of chop-off means 20, FIG. 1, is illustrated to some extent in the sequence of FIGS. 1 (and 3), 5, and 7. As compared to FIGS. 1 and 3 wherein the chop-off mechanism is at the center of its meshing stroke (with the axes of bedroll 21, chop-off roll 23, and carrier 26 vertically aligned), FIG. 5 shows the elements as they are just leaving their meshed relation, and FIG. 7 shows the mechanism after it has rotated to where the blades 31 have been retracted into bedroll 21. During operation of the rewinder, the blades 31 remain retracted until just before a roll ending event is to occur. They are then extended by means not shown; execute the roll ending breaking of the web which is threaded over and under the meshed blades; and then are retracted. Additionally, a transverse array of booties 41 (only one of which is visible in the figures) are extended outward as the blades 31 are retracted. This acts to disengage the free end of the web that has been impaled on pins 33 during the roll ending event. The booties are then promptly retracted.

Figure 2:
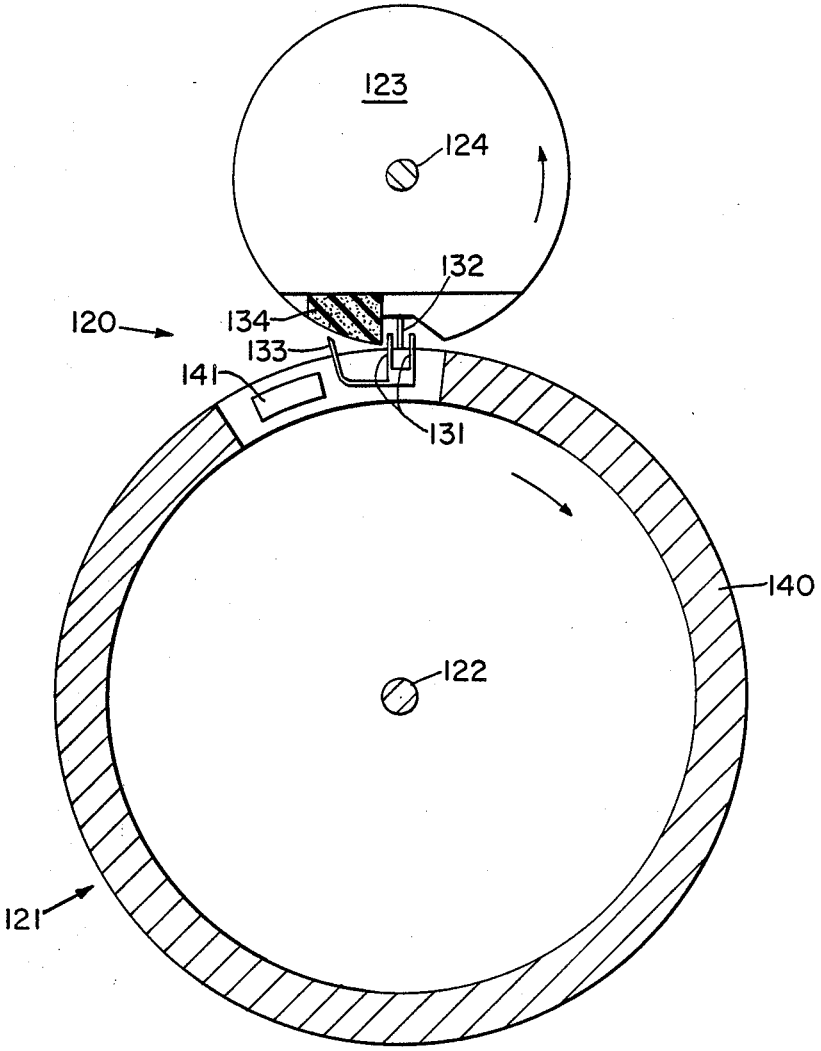
Fig. 2 PRIOR ART
FIG. 2 is a fragmentary, partially cut away, side elevational view of a PRIOR ART chop-off mechanism.
Figure 4:
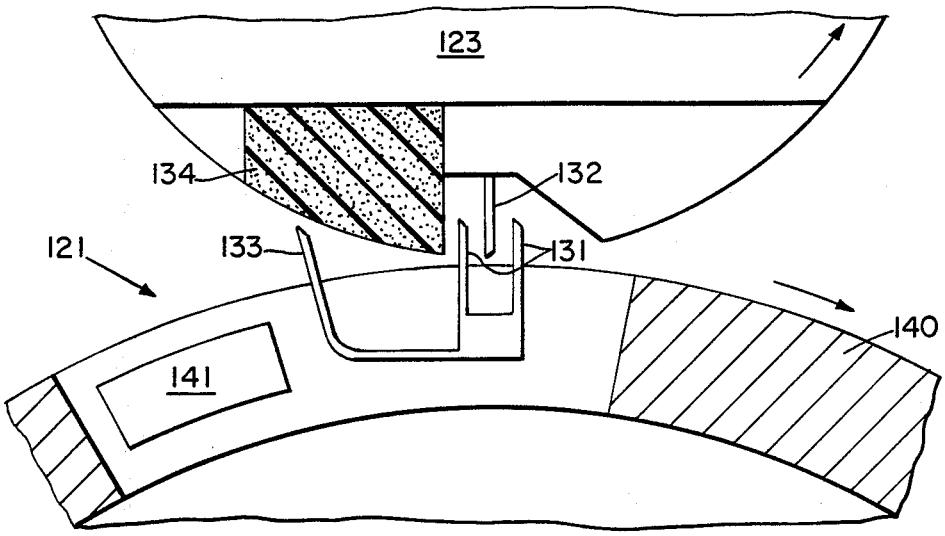
Fig.4 PRIOR ART
FIG. 4 is an enlarged scale view of a portion of the PRIOR ART mechanism shown in FIG. 2.
Figure 6:
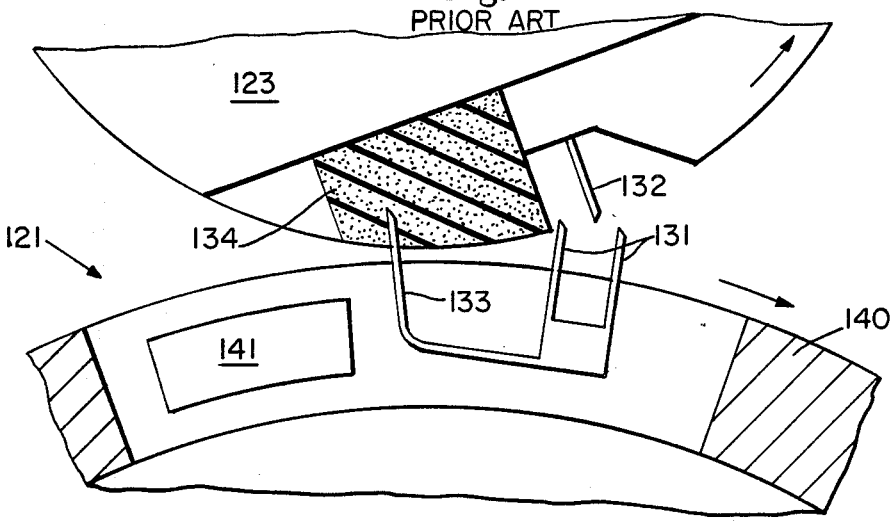
Fig. 6 PRIOR ART
FIG. 6 is a view of the PRIOR ART mechanism of FIG. 4 after its rotational elements have been rotated —one clockwise and the other counterclockwise —far enough that their blades are at their just-leaving-mesh positions.

Turning now to the prior art chop-off mechanism 120 shown in FIGS. 2, 4 and 6, the element designators have the same units and tens digits as corresponding elements of the chop-off mechanism 20, FIGS. 1, 3, 5 and 7. Their designators have, however, a one for a hundreds digit.

The operation of the prior art chop-off mechanism shown in FIGS. 2, 4, and 6 is similar to the operation of chop-off mechanism 20 except that blades 131 and 132 move into and out of meshed relation with a rolling motion. That is, as bedroll 121 rotates on its shaft 122, and chop-off roll 123 rotates on its shaft 124, the blades 131 and 132 roll into and out of meshed relation when blades 131 are extended as shown in the figures. Thus, the prior art chop-off mechanism 120 is said to have a rolling action of its chop-off blades 131 and 132 whereas the present invention provides parallel motion meshing.

Still referring to FIGS. 2, 4 and 6, other elements of the prior art chop-off mechanism 120 include resilient pad 134, booties 141, and bedroll shell or cylinder 140.

Figure 8:
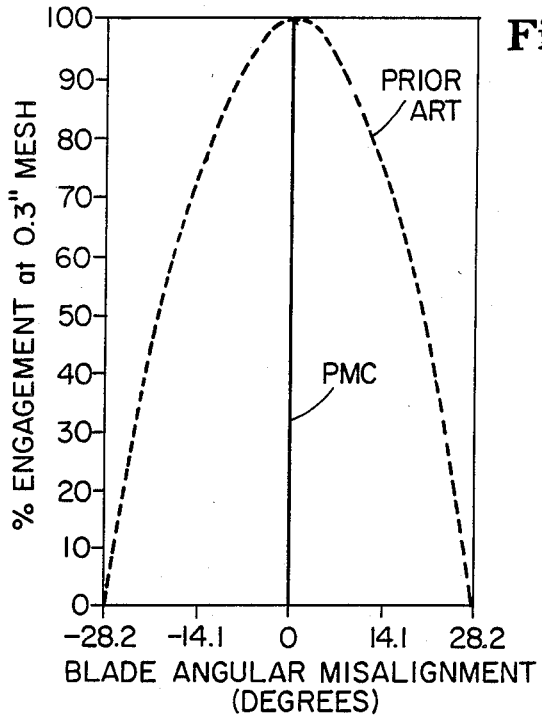
FIG. 8 is a graph which shows the parallel action of the chop-off blades of an embodiment of the present invention as compared to the non-aligned action of the chop-off blades of a PRIOR ART chop-off mechanism.

Referring now to FIG. 8, a graph of Blade Angular Misalignment (Degrees) vs. Percent Engagement illustrates the rolling meshing action of the Prior Art chop-off mechanism 120 vs. the constant parallel meshing action of the improved chop-off mechanism 20 provided by the present invention. The line labeled "PMC" is for the parallel mesh chop-off mechanism 20; and the line labeled "Prior Art" is for the rolling action chop-off mechanism 120. Whereas the PMC remains aligned (parallel; zero misalignment), the Prior Art blades are misaligned −28.2 degrees at the inception of meshing, and are misaligned 28.2 degrees at the end of meshing. Thus, for blades of a given width, the blades of the Prior Art mechanism must be spaced further apart to avoid interference than they can be spaced on the PMC mechanism. Such a wider spacing of Prior Art blades provides less available maximum percent elongation of a length of web spanning the tips of blades 131, than is available for a length of web spanning the tips of adjacent blades 31 in the PMC mechanism. For example, blades 131 and 132 of an exemplary prior art chop-off mechanism 120 are sixty thousandths of an inch (about 0.15 cm) thick and are spaced three-eights of an inch (about 0.95 cm) apart to accommodate the rolling type meshing, whereas the blades 31 and 32 of the exemplary embodiment of chop-off mechanism described hereinbefore are of equal thickness, but are spaced only one-fourth inch (about 0.64 cm) apart. Thus, for equal maximum meshes (e.g., 0.300 inches) (about 0.76 cm), the Prior Art mechanism will stretch its three-eighths inch span of web a maximum of about eighty percent; and the PMC mechanism having a 3-blade set of chop-off blades will stretch its one-quarter inch span of web a maximum of about one-hundred-sixty percent. The greater available maximum percentage of stretch provided by the present invention —the PMC mechanism —provides greater assurance of breaking the web during a roll ending event than the Prior Art mechanism. This is true for the three blade sets of chop-off blades described above, as well as for blade sets comprising more than 3 blades. For example, because the blades can be more closely spaced in accordance with the present invention, five blade sets as shown in the figures are practical. These provide windows of greater width as described hereinbefore and thus make it easier to maintain the desired indexed relationship between the transverse lines of weakening in the running web, and the window of meshed blades: i.e., to assure breaking the web along lines of weakening to provide esthetically pleasing roll ends rather than tearing the web if it gets out of registrations (misindexed) with the chop-off mechanism.

Figure 9:
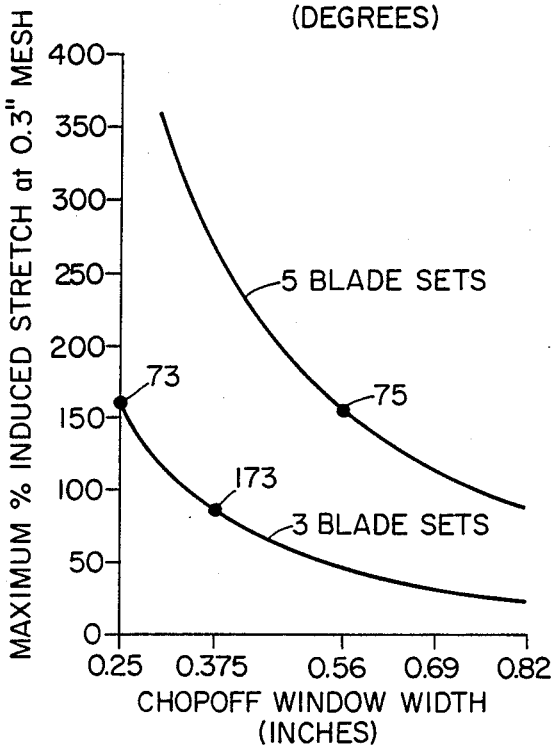
FIG. 9 is a graph which shows induced stretch vs window width data for 3-blade and 5-blade sets of chop-off blades.

Referring to FIG. 9, a graph, the relationship between chop-off window width and maximum available percent stretch for chop-off mechanisms having 3-blade and 5-blade sets of chop-off blades is shown: both curves being for mechanisms with blades having thicknesses of sixty thousandths of an inch (about 0.15 cm) and maximum meshes of three-tenths inches (about 0.76 cm). Point 73 represents a PMC mechanism having a 3-blade set, and point 173 represents a Prior Art mechanism having a 3-blade set. Point 75 represents a PMC apparatus having a 5-blade set of chop-off blades. This further illustrates the greater available percent stretch provided by the present invention: an important feature for converters of webs having high stretch properties such as, for example, creped paper and thermoplastic films.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An improved chop-off means in a rewinder apparatus of the type which includes means for unwinding a parent roll of web material and forwarding unwound web through the apparatus, means for providing transverse lines of weakening in said web at sheet length intervals in the machine direction, chop-off means for breaking the web along lines of weakening at product roll length intervals, and means for winding the product roll lengths of web into product rolls, and in which the chop-off means comprises a bedroll, a chop-off roll, means for rotating the bedroll and the chop-off roll in timed relation, and a set of chop-off blades, some of which are mounted on the bedroll and some of which are mounted on the chop-off roll, and which blades are rotationally moved into and then out of a non-contacting meshed relation by simple rotational motion of the bedroll and the chop-off roll only during a web breaking, roll ending event, said improvement comprising means for continuously maintaining the chop-off blades of both the bedroll and the chop-off roll in mutually parallel relation and synchronized velocity.

2. The improved chop-off means of claim 1 wherein said improvement comprises means for continuously maintaining the chop-off and bedroll blades in mutually parallel relation throughout their complete adjacent orbits.

3. The improved chop-off means of claim 2 wherein said means for continuously maintaining the chop-off blades in parallel relation comprises means for orbiting the chop-off roll in a circular orbit adjacent the bedroll and in timed relationship therewith, and means for rotating the chop-off roll on its axis at the same spatial angular velocity as the bedroll and in angularly indexed relation therewith, and means for indexing said orbiting means with the rotation of the bedroll so that the chop-off blades are continuously maintained in parallel relation.

4. The improved chop-off means of claim 1 wherein said set of blades comprises at least three blades, and at least one of said blades is mounted on each of the rolls.

5. The improved chop-off means of claim 1 wherein said set of blades comprises at least four blades, and at least two of said blades are mounted on each of the rolls.

6. The improved chop-off means of claim 1 wherein said set of blades comprises five blades, two of said blades being mounted on the chop-off roll, and three of said blades being mounted on the bedroll.

7. The improved chop-off means of claim 1 wherein said blades are circumferentially spaced relatively close together.

* * * * *

UNITED STATES PATENT AND TRADEMARK OFFICE

CERTIFICATE OF CORRECTION

PATENT NO. : 4,919,351

DATED : April 24, 1990

INVENTOR(S) : Kevin B. McNeil

It is certified that error appears in the above-identified patent and that said Letters Patent is hereby corrected as shown below:

ON TITLE PAGE:

Abstract, Column 2, line 20, delete "edging" and insert therefor -ending-.

Column 5, line 27, delete "one-fourth" and insert therefor -one quarter-.

Column 6, line 46, delete "one-fourth" and insert therefor -one-quarter-.

Signed and Sealed this

Third Day of December, 1991

*Attest:*

HARRY F. MANBECK, JR.

*Attesting Officer*

*Commissioner of Patents and Trademarks*